US011598164B2

(12) United States Patent
Grosz

(10) Patent No.: US 11,598,164 B2
(45) Date of Patent: Mar. 7, 2023

(54) FLEXIBLE BASKET DRILL BIT BREAKER

(71) Applicant: Halliburton Energy Services, Inc., Houston, TX (US)

(72) Inventor: Gregory C Grosz, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 255 days.

(21) Appl. No.: 17/276,402

(22) PCT Filed: Dec. 20, 2018

(86) PCT No.: PCT/US2018/066724
§ 371 (c)(1),
(2) Date: Mar. 15, 2021

(87) PCT Pub. No.: WO2020/131060
PCT Pub. Date: Jun. 25, 2020

(65) Prior Publication Data

US 2022/0042381 A1 Feb. 10, 2022

(51) Int. Cl.
*E21B 10/42* (2006.01)
*E21B 19/18* (2006.01)

(52) U.S. Cl.
CPC ..... *E21B 19/18* (2013.01); *E21B 10/42* (2013.01)

(58) Field of Classification Search
CPC ..... E21B 10/42; E21B 19/18; E21B 10/00; E21B 17/16; B25B 13/00
See application file for complete search history.

(56) References Cited

U.S. PATENT DOCUMENTS

| | | | | |
|---|---|---|---|---|
| 2,075,426 | A * | 3/1937 | Church | E21B 19/10 166/85.1 |
| 4,352,399 | A | 10/1982 | Davis | |
| 4,495,840 | A | 1/1985 | Freitag | |
| 4,924,954 | A | 5/1990 | Mead | |
| 6,311,789 | B1 | 11/2001 | Saxman | |
| 10,370,912 | B2 * | 8/2019 | Tavakoli | E21B 17/042 |
| 10,662,714 | B2 * | 5/2020 | Cunningham | E21B 10/00 |
| 11,136,839 | B2 * | 10/2021 | St. Pierre | E21B 19/18 |
| 11,391,101 | B2 * | 7/2022 | Odegard | E21B 19/18 |
| 2010/0319997 | A1 | 12/2010 | King | |
| 2012/0234601 | A1 * | 9/2012 | Griffin | E21B 19/18 175/57 |

(Continued)

OTHER PUBLICATIONS

International Search Report and Written Opinion dated Sep. 17, 2019 for related PCT Application No. PCT/2018/066724 filed Dec. 20, 2018.

*Primary Examiner* — Daniel P Stephenson
(74) *Attorney, Agent, or Firm* — K&L Gates LLP

(57) ABSTRACT

A bit breaker for making or breaking a connection between a drill bit and a drill string, and the bit breaker includes a support structure that has a bit aperture through which a portion of the drill bit may pass. The support structure also includes basket apertures positioned circumferentially around the bit aperture. The bit breaker also includes a flexible member that passes through the basket apertures of the support structure to form a basket extending from one side of the support structure that can receive a drill bit. Relative rotation between the support structure and the flexible member causes the flexible member to tighten to make or break the connection between the drill bit and the drill string.

20 Claims, 10 Drawing Sheets

(56) References Cited

U.S. PATENT DOCUMENTS

2015/0315859 A1* 11/2015 Strydom ..... E21B 17/1085
166/85.5
2022/0042381 A1* 2/2022 Grosz ..... E21B 19/18

* cited by examiner

FLEXIBLE BASKET DRILL BIT BREAKER

BACKGROUND

In a drilling operation, a drill string includes a drill bit that rotates to penetrate the Earth's surface. The harsh operating parameters including high temperatures, weight on bit, rotation, and complex drilling dynamics create a large amount of wear on the drill bit. Drill bits must therefore be replaced periodically. It is common for multiple drill bits to be consumed in the process of drilling a single well.

Because of rotational and other forces acting on the drill bit, a high torque is generally applied to a drill bit when coupling it to the drill string. Drill bits typically have slots that engage with a breaker plate to apply torque to the drill bit while making or breaking a connection between the drill bit and the drill string. All of the torque may be applied along the slots, which produces stress concentrations in the drill bit. Further, different drill bits may have different sized or different shaped slots, and therefore necessitating multiple breaker plates.

BRIEF DESCRIPTION OF THE DRAWINGS

Embodiments of the system and method for attaching and removing a drill bit are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
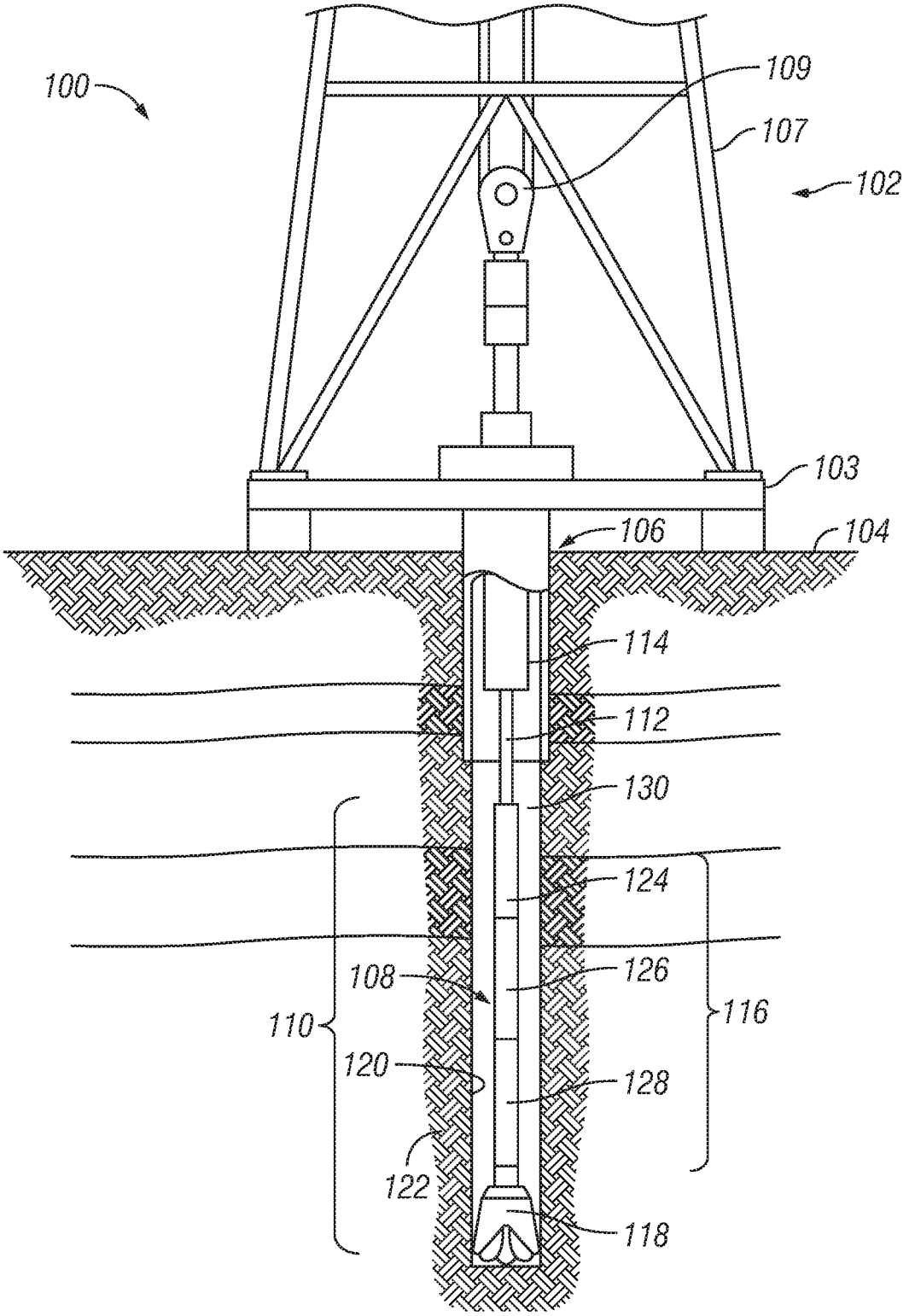
FIG. 1 illustrates a schematic view of a well system with a drill string.

FIG. 1 illustrates an example drilling system 100 including a drilling rig 102 located at a surface 104 of a well 106. The drilling rig 102 includes a drilling platform 103 that is equipped with a derrick 107 to physically support the structure of the drilling rig 102, including a drill string 108 and an elevator 109 that can raise and lower the drill string 108.

The drill string 108 includes a bottom hole assembly ("BHA") 110 located at the lower portion of a drill pipe 112.

The BHA 110 includes a downhole motor assembly 116, and a drill bit 118. The drill bit 118 operates to create a borehole 120 by penetrating the surface 104 and subsurface formations 122. The downhole motor assembly 116 includes a power section 124 that provides power for rotating the drill bit 118, a transmission section 126 that converts the eccentric rotation (i.e., nutation about a central axis of the stator) of the rotor of the power section 124 to a concentric rotation (i.e., rotation about central axis) before reaching the drill bit 118, and a bearing section 128 that provides protection to the BHA 110 from off bottom and on bottom pressures. Drill collars may be optionally included to add weight and stiffen the BHA 110, to transfer the added weight to the drill bit 118, and in turn, to assist the drill bit 118 in penetrating the surface 104 and subsurface formations 122. The connection between the drill bit 118 and the rest of the BHA 110 is able to withstand the rotational forces applied to the drill bit 118 during a drilling operation.

Figure 2A:
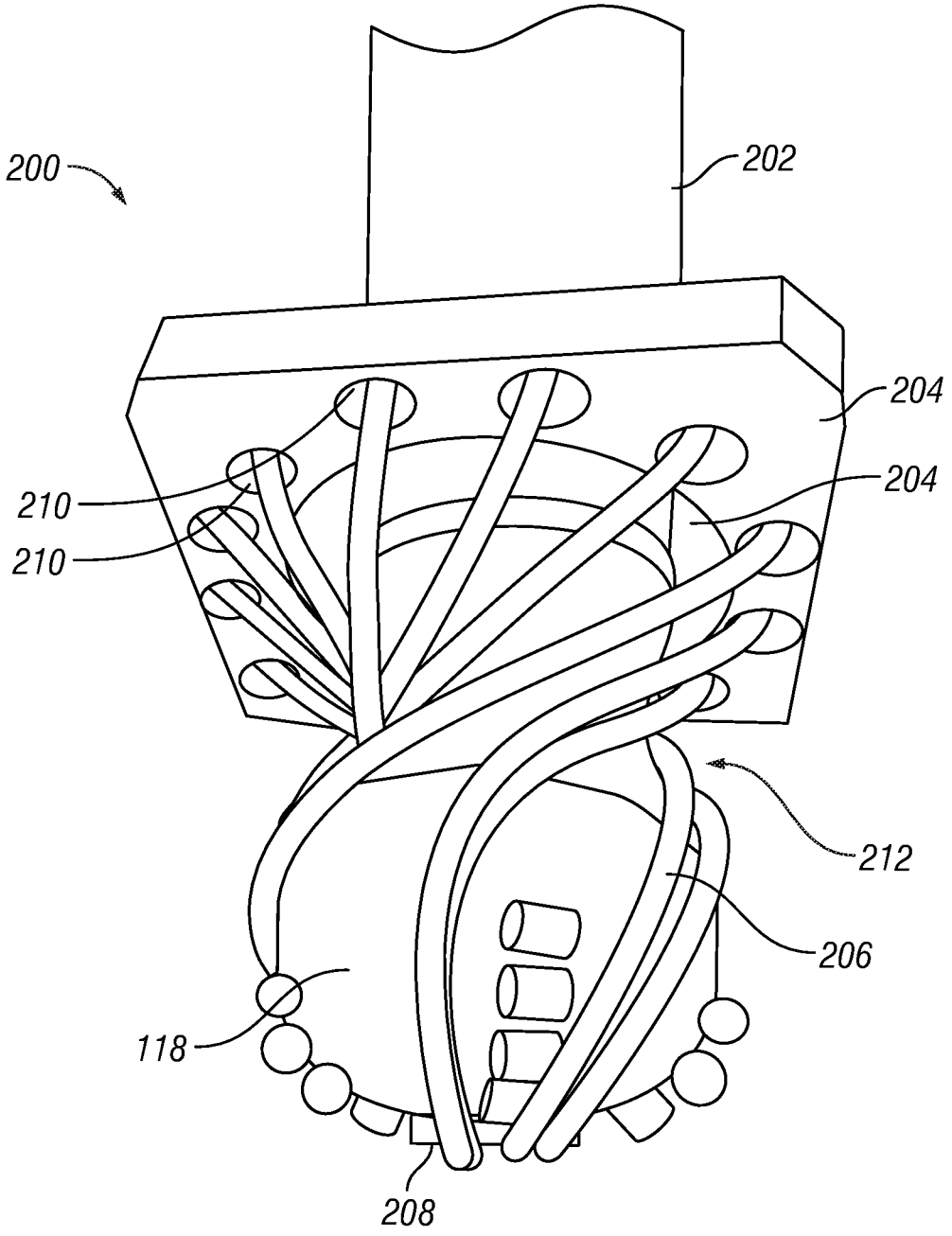
FIG. 2A illustrates a perspective view of a drill bit within a bit breaker.

As shown in FIG. 2A, a bit breaker 200 is utilized to make or break the connection between the drill bit 118 and the drill string 202. The drill bit 118 is connected to the drill string 202 via a bit sub, but it should be appreciated that the drill bit 118 may connect to any threaded portion of the drill string 202.

When making or breaking the connection between the drill bit 118 and the drill string 202, at least a portion of the drill bit 118 is placed into the bit breaker 200, which is accomplished by passing a support structure 204 of the bit breaker over the drill bit 118 and wrapping a flexible member 206 around the drill bit 118. As the drill bit 118 and the support structure 204 rotate relative to one another, the flexible member 206 tightens around the drill bit 118 and can transfer torque to the drill bit 118. With a sufficient amount of torque transfer between the flexible member 206 and the drill bit 118, the flexible member 206 can make or break the connection between the drill bit 118 and the drill string 202 or to whatever else the drill bit is attached.

The flexible member 206 is coupled to the support structure 204 and a static ring 208. The flexible member 206 loops through basket holes 210 (e.g., apertures) in the support structure 204 and through the static ring 208 to form a basket 212 that can receive the drill bit 118. The support structure 204 and the static ring 208 provide static, relatively fixed (i.e., some movement may occur while the flexible member 206 is tightening and remain fixed thereafter) points about which the flexible member 206 can stretch and tighten. The basket holes 210 includes apertures through the support structure 204, and the basket holes 210 are positioned circumferentially around a bit hole 214 (e.g., aperture) of the support structure 204. The number of basket holes 214 may vary, and may include 3 or more holes.

Figure 2B:
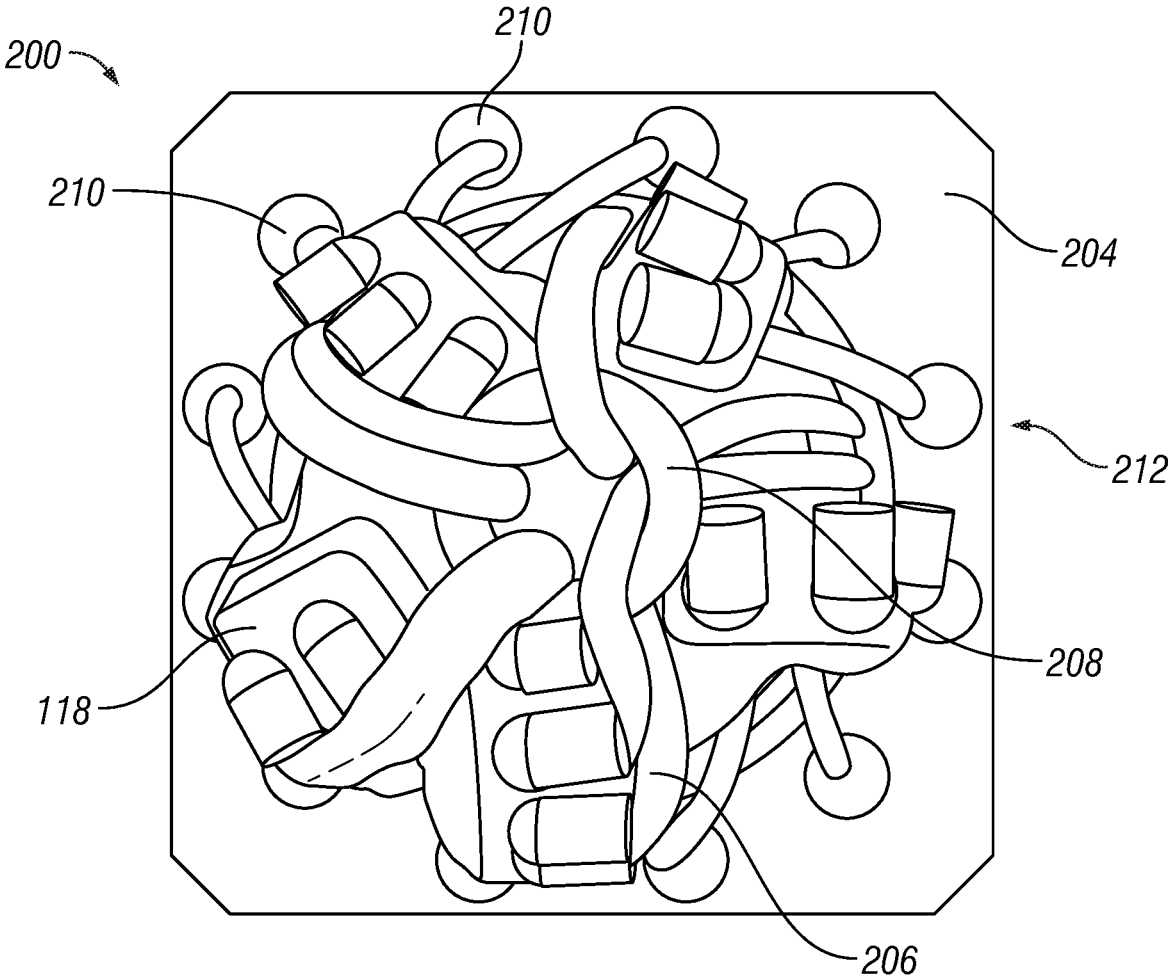
FIG. 2B illustrates a bottom view of the drill bit within the bit breaker of FIG. 2A.

The static ring 208, as shown in FIG. 2B, supports the basket 212 at an end opposite of the support structure 204 and, in one or more embodiments, may include knots in the flexible member 206. The static ring 208 provides a second static point opposite of the support structure 204 around which the flexible member 206 can stretch and tighten.

The flexible member 206 that is looped through the basket holes 214 and the static ring 208 may be a continuous piece or multiple pieces coupled together. The flexible member 206 may include any elongated flexible material, such a rope, a belt such as a serpentine belt, a chain, a strap, a cord, a wire, or a cable. Further, the flexible member 206 may include polypropylene, nylon, polyesters, polyethylene, Aramids, acrylics, steel, manila hemp, hemp, linen, cotton, coir, jute, straw, sisal, or any combinations thereof.

Further, because the basket 212 is flexible, the basket 212 can change its shape and size to receive drill bits having different shapes and sizes. For example, the drill bit 118 is first passed through the bit hole 214 in the support structure 204 before being received in the basket 212. Because the support structure 204 is static, the bit hole 214 may limit the diameter of drill bit 118 that can be received in the basket 212. Size ranges for drill bits 118 may include 3.5 inches to 4.63 inches, 4.63 inches to 5.03 inches, 5.03 inches to 7.41 inches, 7.41 inches to 9.41 inches, 9.41 inches to 14.56 inches, 14.56 inches to 18.56 inches, and greater than 18.56 inches. Further, because the basket 212 is flexible, the basket 212 may receive drill bits that would be too small for a static bit breaker. This enables the bit breaker 200 to make and break connections of drill bits across multiple size ranges with a single bit hole 214.

When the basket 212 tightens around the drill bit 118, the basket 212 transfers torque to the drill bit 118 along the length of the basket 212 in contact with the drill bit 118. In this manner, the basket 212 can apply the torque to the drill bit 118 over a greater area when compared to bit breakers that employ a breaker plate that contact the drill bit 118 along predetermined slots. Further, the bit breaker 200 can make or break connections with drill bits that do not include any structure included specifically for use with a bit breaker, such as slots. This structure, such as slots, may be eliminated from the drill bits which may reduce stress concentration areas and cyclical loading environments. Further, drill bits may be made shorter with a reduced make up length.

Figure 3A:
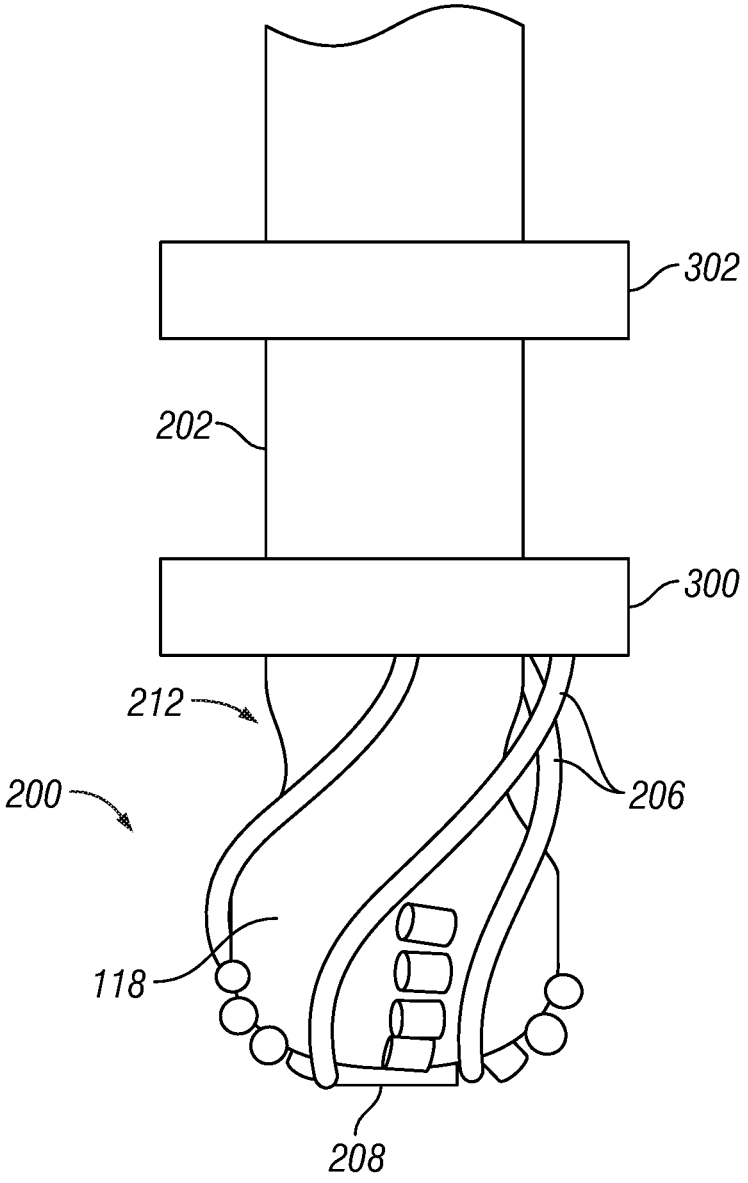
FIG. 3A illustrates a lateral view of a drill bit being attached to a drill string using a bit breaker.
Figure 3B:
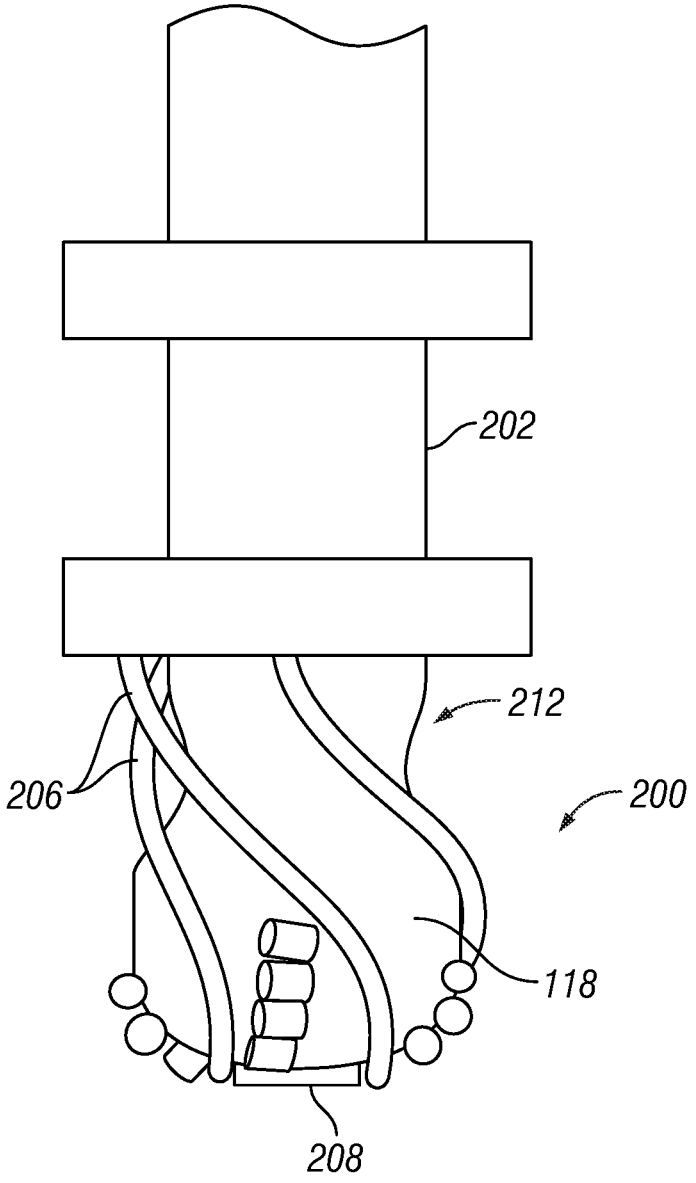
FIG. 3B a lateral view of a drill bit being detached to a drill string using a bit breaker.

FIGS. 3A and 3B illustrate making and breaking, respectively, a connection between the drill bit 118 and the drill string 202. As shown, the drill bit 118 is already placed within the basket 212 as described above. Further, the bit breaker 200 has been rotated at least partially to tighten the flexible member 206 onto the drill bit 118. The support structure 204 is within a bit breaker clamp 300 (and thus not visible) and the drill string 202 is within a drill string clamp 302. The outer dimensions of the support structure 204 are sized to fit within the bit breaker clamp 300. For example, the outer dimensions of the support structure fit within a 17.5 inch square.

After the drill string clamp 302 has clamped the drill string 202, and the bit breaker clamp 300 has clamped the support structure 204, the drill string clamp 302 or the bit breaker clamp 300 rotate relative to one another. For example, one of the drill string clamp 302 or the bit breaker clamp 300 may rotate while the other remains stationary. Initially, the relative rotation tightens the flexible member 206 onto the drill bit 118. Then, continued relative rotation makes or breaks the connection between the drill bit 118 and the drill string 202 (or other object), depending on the direction of rotation. For example, rotation in one direction makes the connection between the drill bit 118 and the drill string 202 while rotation in the opposite direction breaks the connection between the drill bit 118 and the drill string 202. When breaking the connection between the drill bit 118 and the drill string 202, the basket 212 may also retain the drill bit 118 after fully breaking the connection, thereby preventing the drill bit 118 from falling. After making or breaking the connection between the drill bit 118 and the drill string 202, the basket is returned to a relaxed position and removed from the drill bit 118.

Figure 4A:
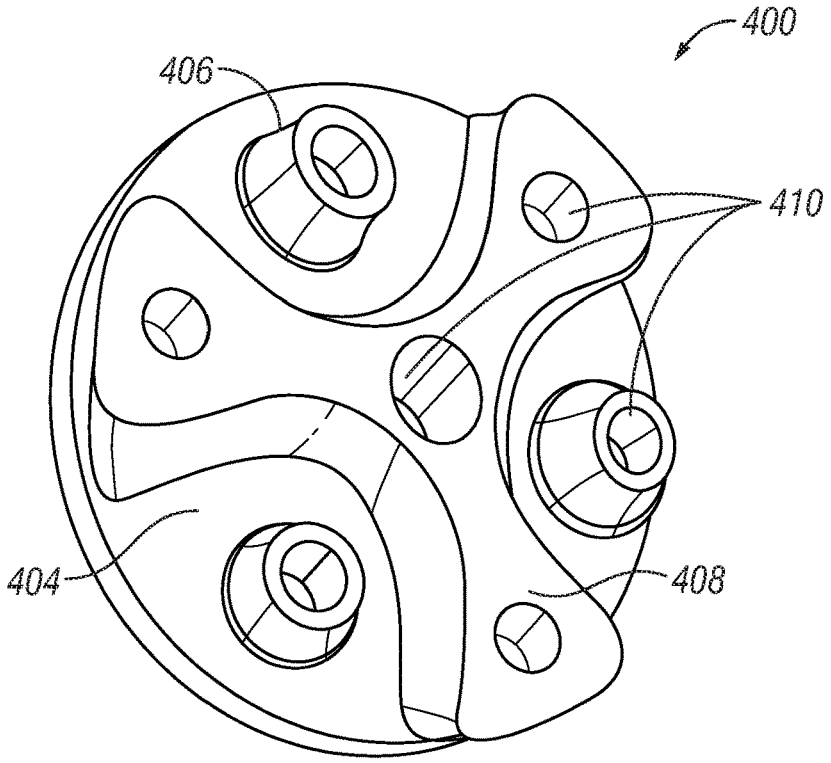
FIGS. 4A and 4B illustrate side views of opposing sides of a static ring.
Figure 4B:
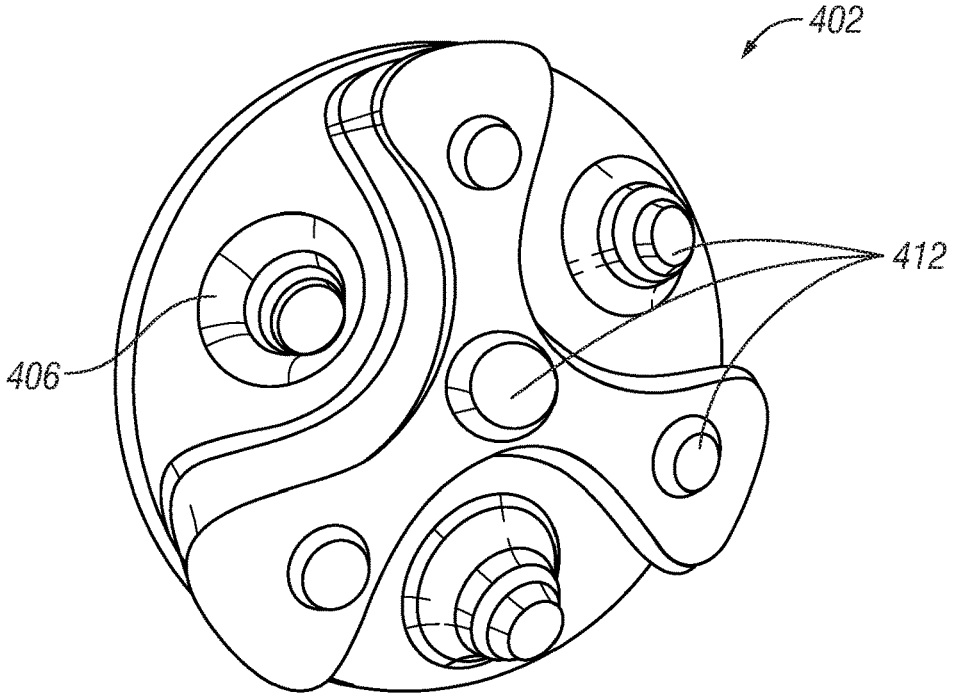

FIGS. 4A and 4B illustrate a first section 400 and a second section 402 of an embodiment of a static ring that may be employed in place of the static ring 208. The first section 400 and the second section 402 fit together to form a single static ring through which a flexible member can fit. Each of the first section 400 and the second section 402 has multiple complementary channels 404, each for receiving a portion of the flexible member. Further, each of the first section 400 and the second section 402 include a separator 408 and a blocking member 406 to separate and define each channel 404.

Figure 5A:
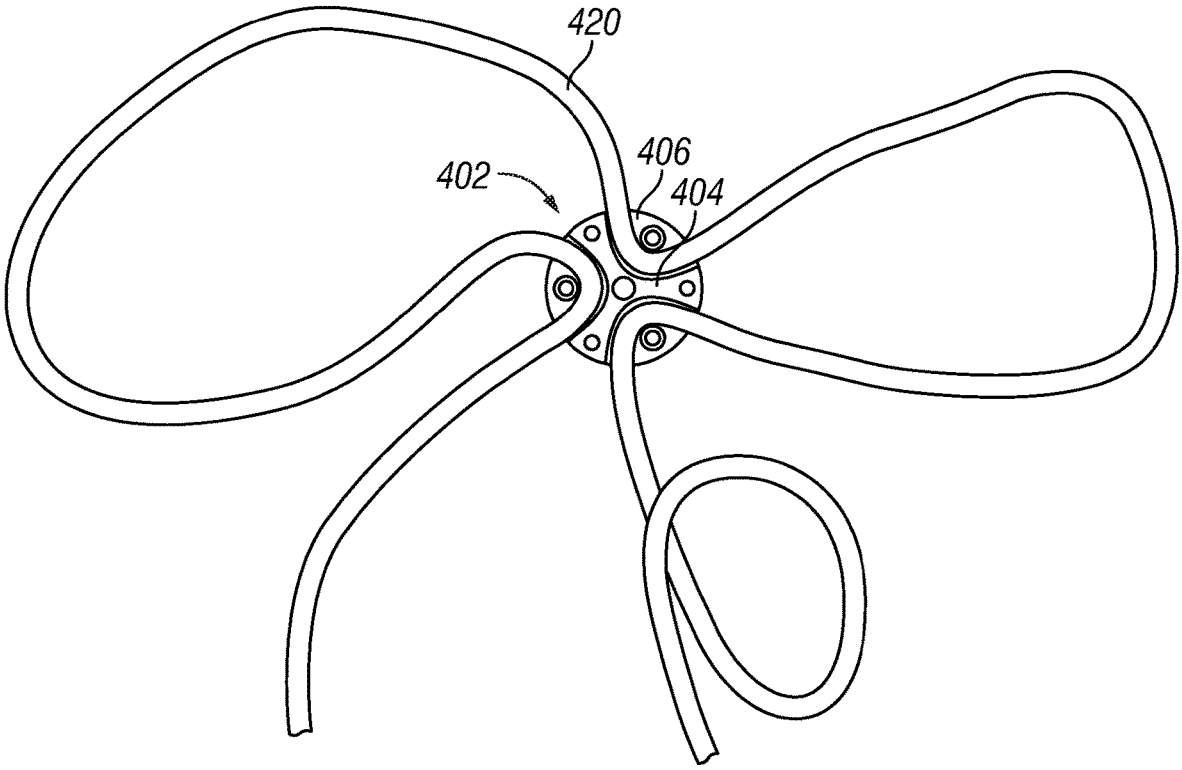
FIG. 5A illustrates a perspective view of a flexible member positioned within a side of a static ring.
Figure 5B:
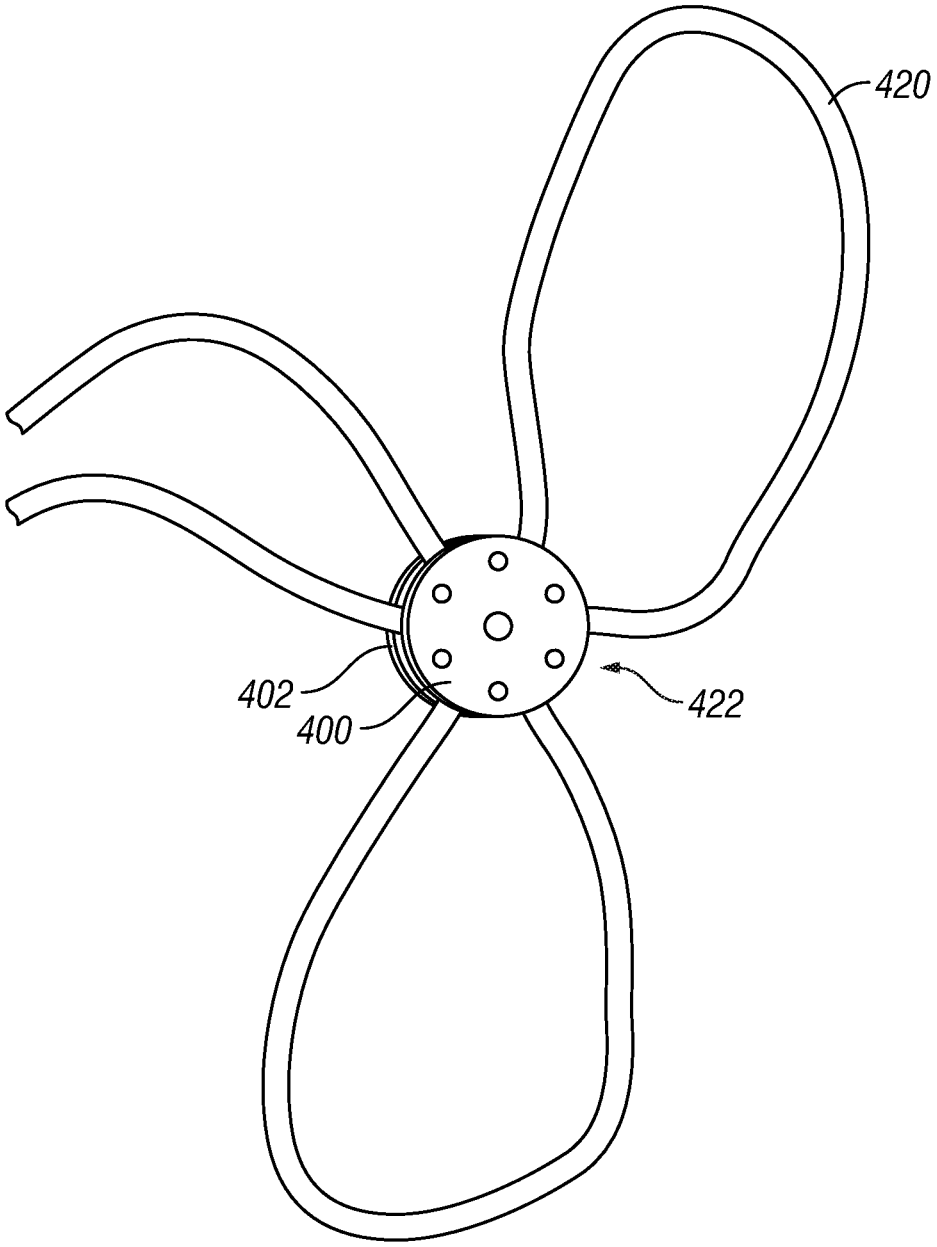
FIG. 5B illustrates a perspective view of the flexible member of FIG. 5A enclosed within both sides of the static ring.

To fit the first section 400 and the second section 402 together, the first section 400 includes receptacles 410 to receive the protrusions 412 of the second section 402. When the first section 400 and the second section 402 are attached together, the blocking members 406 prevent the flexible member from exiting the respective channel 404. For example, as shown in FIG. 5A, a flexible member 420 is placed in each of the channels 404 of the second section 402. The blocking members 406 hold the flexible member 420 within each respective channel 404. Then, in FIG. 5B, the first section 400 is placed over the second section 402 to form a static ring 422 that holds the flexible member 420 to provide structural support and a static point for the flexible member 420.

Figure 6:
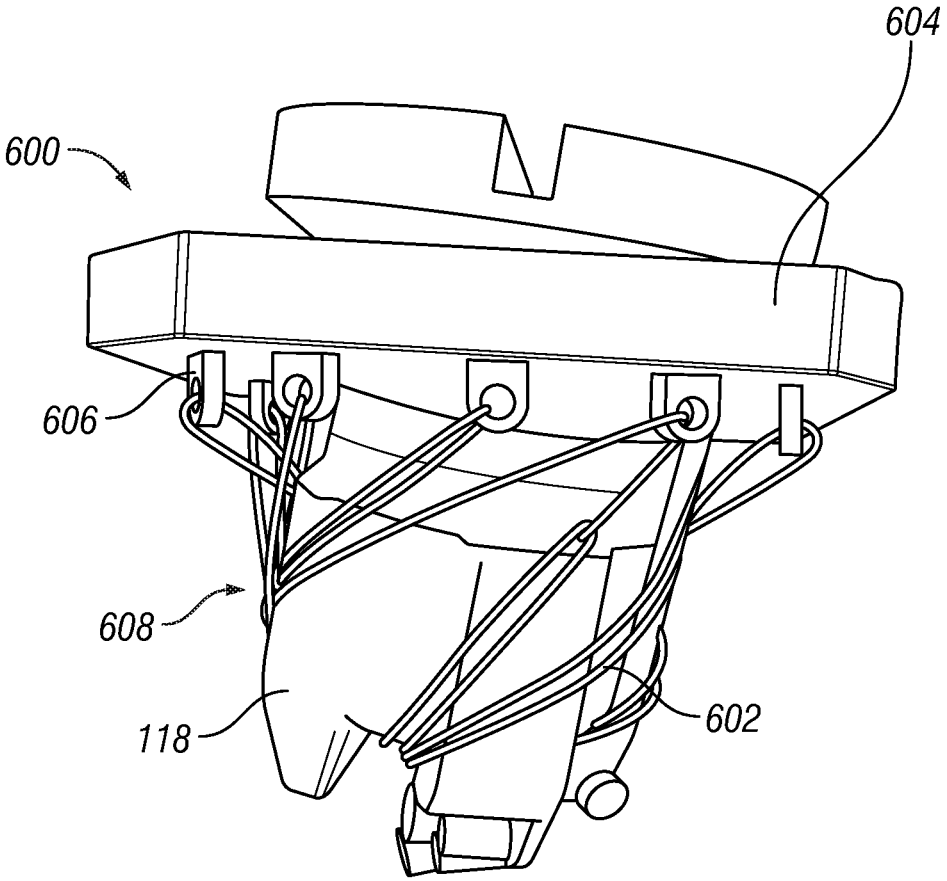
FIG. 6 illustrates a perspective view of a drill bit within a bit breaker.

FIG. 6 illustrates an embodiment of a bit breaker 600 used for making and breaking connections between a drill bit 118 and a drill string or other object. The bit breaker 600 includes a flexible member 602 that tightens around the drill bit 118 as described above. The flexible member 602 is coupled to a support structure 604 via rings 606 on one side of the support structure 604. The rings 606 may be formed integrally to the support structure 604, or the rings 606 may be coupled to the support structure 604, such as by welding. The flexible member 602 passes through the rings 606 to form a basket 608 that receives the drill bit 118. As the drill bit 118 and the support structure 604 rotate relative to one another, the flexible member 602 tightens around the drill bit 118 and can transfer torque to the drill bit 118. With a sufficient amount of torque transfer between the flexible member 602 and the drill bit 118, the flexible member 602 can make or break the connection between the drill bit 118 and the drill string.

Figure 7:
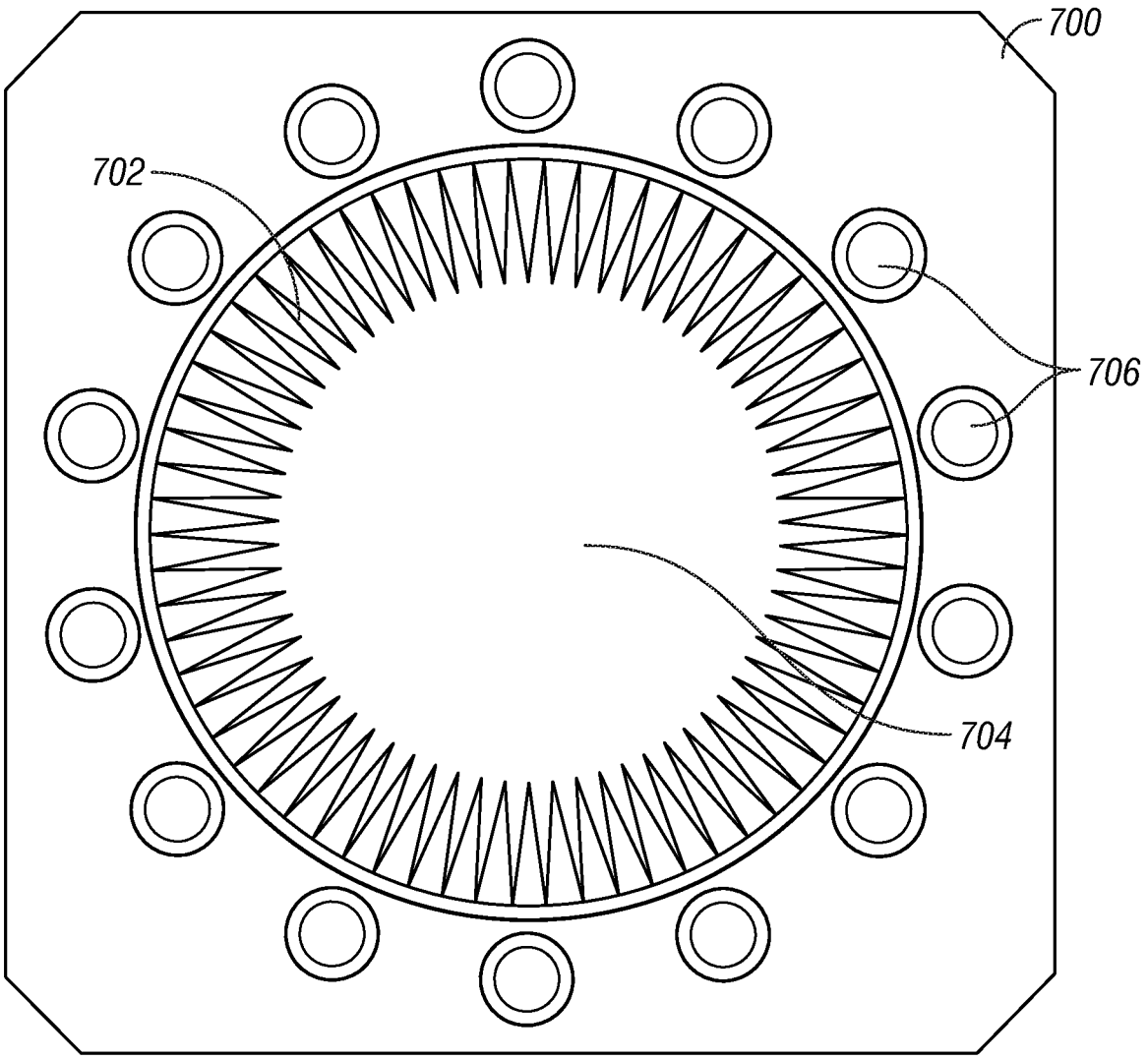
FIG. 7 illustrates a perspective view of another embodiment of a support structure of a bit breaker with a centralizing member.

FIG. 7 illustrates an embodiment of a support structure 700 that includes a centralizing member 702 positioned in a drill bit hole 704. The support structure 700 includes basket holes 706, but may also include rings, as described above. The centralizing member 702 is flexible to allow a drill bit passing through the drill bit hole 704. After the drill bit has passed through the drill bit hole 704, the centralizing member 702 provides stability to the drill bit while making or breaking a connection of the drill bit. The centralizing member 702 biases the drill bit into alignment with a central axis of the support structure 700. Further, when making or breaking a connection between the drill bit and the drill string, the central axis of the support structure is aligned with the central axis of the drill string. As such, the centralizing member 702 biases the drill bit into alignment with the central axis of the drill string as well. The support provided by the centralizing member 702 may make the process of making and breaking the connection of the drill bit easier for an operator.

The centralizing member 702 is coupled to the support structure, such as along a diameter of the bit hole 704, and the centralizing member 702 extends radially inwardly toward the central axis of the support structure 700 and into the aperture provided by the bit hole 704. The centralizing member 702 is composed, for example, of an elastomer to provide flexibility sufficient to allow the drill bit to pass through the centralizing member 702. Further, the centralizing member 702 is made up of multiple triangles; however, in one or more embodiments, the centralizing member 702 may be made up of other polygonal shapes.

Further examples may include:

Example 1 is a bit breaker for making or breaking a connection between a drill bit and a drill string, and the bit breaker includes a support structure that has a bit aperture through which a portion of the drill bit may pass. The support structure also includes basket apertures positioned circumferentially around the bit aperture. The bit breaker also includes a flexible member that passes through the basket apertures of the support structure to form a basket extending from one side of the support structure that can receive a drill bit. Relative rotation between the support structure and the flexible member causes the flexible member to tighten to make or break the connection between the drill bit and the drill string.

In Example 2, the subject matter of Example 1 can further include a static ring that has a channel to receive a portion of the flexible member such that the flexible member forms the basket between the support structure and the static ring.

In Example 3, the subject matter of Examples 1-2 can further include wherein the static ring is made of two halves. Each section includes a raised separator portion to form the channel when the two halves are joined together.

In Example 4, the subject matter of Examples 1-3 can further include wherein each section has one of a receptacle or a complementary insert that fits within the receptacle.

In Example 5, the subject matter of Examples 1~4 can further include wherein the flexible member is single continuous piece.

In Example 6, the subject matter of Examples 1-5 can further include wherein the flexible member comprises one of a rope, a cord, a belt, a strap, a chain, a wire, or a cable.

In Example 7, the subject matter of Examples 1-6 can further include wherein the support structure includes a centralizing member that biases the drill bit to align a central axis of the drill bit with a central axis of the support structure.

In Example 8, the subject matter of Examples 1-7 can further include wherein the centralizing member is formed on a diameter of the bit aperture and extends radially inward toward the central axis of the support structure.

In Example 9, the subject matter of Examples 1-8 can further include wherein the basket apertures comprise four to fourteen apertures.

In Example 10, the subject matter of Examples 1-9 can further include wherein the basket apertures comprise rings extending from one side of the support structure.

In Example 11, the subject matter of Examples 1-10 can further include wherein the flexible member is composed of one or more of the following materials: polypropylene, nylon, polyesters, polyethylene, aramids, acrylics, steel, manila hemp, hemp, linen, cotton, coir, jute, straw, and sisal.

Example 12 is a method for making or breaking a connection between a drill bit and a drill string. The method includes forming a basket with a flexible member on a bit breaker by passing the flexible member through basket apertures in a support structure of the bit breaker and extending the flexible member from the basket apertures through a linkage axially separated from the support structure. The method also includes placing the drill bit in the basket formed by the flexible member such that the flexible member is wrapped around the drill bit. Further, the method includes rotating one of the drill bit or the support structure to tighten the flexible member about the drill bit. Moreover, the method includes continue rotating one of the drill bit or the support structure to make or break the connection between the drill bit and the drill string.

In Example 13, the subject matter of Example 12 can further include looping the flexible member through each basket aperture multiple times.

In Example 14, the subject matter of Examples 12-13 can further include passing the drill bit through a bit aperture to place the drill bit in the basket.

In Example 15, the subject matter of Examples 12-14 can further include clamping the drill string and the support structure separately to allow relative rotating between the drill string and the support structure.

In Example 16, the subject matter of Examples 12-15 can further include wherein the linkage is a static ring and the flexible member is coupled to the static ring.

In Example 17, the subject matter of Examples 12-16 can further include wherein coupling the flexible member to the static ring includes looping the flexible member through channels of the static ring.

In Example 18, the subject matter of Examples 12-17 can further include centralizing the drill bit in a bit aperture with a centralizing member to align a central axis of the drill bit with a central axis of the support structure.

In Example 19, the subject matter of Examples 12-18 can further include wherein the centralizing member is formed on a diameter of the bit aperture and extends radially inward toward a central axis of the support structure.

Example 20 is a system for making or breaking a connection between a drill bit and a drill string. The system includes a bit breaker that includes a support structure that has a bit aperture through which a portion of the drill bit may pass. The support structure also includes basket apertures positioned circumferentially around the bit aperture. The bit breaker also includes a flexible member that passes through the basket apertures of the support structure to form a basket extending from one side of the support structure that can receive a drill bit. Relative rotation between the support structure and the flexible member causes the flexible member to tighten to make up or break up the connection between the drill bit and the drill string. In addition, the system includes a drill bit clamp comprising arms that engage with the support structure of the bit breaker to lock the support structure in place. Moreover, the system includes a drill string clamp comprising arms that engage with the drill string to lock the drill string in place and enable relative rotation between the bit breaker and the drill string.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A bit breaker for use with a drill bit, comprising:

a support structure including a bit aperture for receiving a portion of the drill bit and a plurality of basket apertures positioned circumferentially around the bit aperture; and a basket including a flexible member that passes through the basket apertures of the support structure to form the basket, wherein the basket extends from the support structure and is configured to receive the drill bit, wherein relative rotation between the support structure and the flexible member causes the flexible member to tighten around the drill bit to apply a torque to the drill bit to make or break the drill bit connection.

2. The bit breaker of claim 1, further comprising a static ring comprising a channel to receive a portion of the flexible member and position the flexible member such that the flexible member forms the basket between the support structure and the static ring.

3. The bit breaker of claim 2, wherein the static ring comprises two sections, each section comprising a raised separator to form the channel when the two sections are joined together.

4. The bit breaker of claim 3, wherein each section comprises one of a receptacle or a complementary insert that fits within the receptacle.

5. The bit breaker tool of claim 1, wherein the flexible member is single, continuous piece.

6. The bit breaker of claim 1, wherein the flexible member comprises a rope, a cord, a belt, a strap, a chain, a wire, or a cable.

7. The bit breaker of claim 1, wherein the support structure comprises a centralizing member that biases the drill bit to align a central axis of the drill bit with a central axis of the support structure as the drill bit is received in the support structure.

8. The bit breaker of claim 7, wherein the centralizing member is formed on a diameter of the bit aperture and extends radially inward toward the central axis of the support structure.

9. The bit breaker of claim 1, wherein the basket apertures comprise four to fourteen apertures.

10. The bit breaker of claim 1, wherein the basket apertures comprise rings extending on one side of the support structure.

11. The bit breaker of claim 1, wherein the flexible member comprises one or more of polypropylene, nylon, polyesters, polyethylene, aramids, acrylics, steel, manila hemp, hemp, linen, cotton, coir, jute, straw, sisal, or any combination thereof.

12. A method for use with a drill bit, comprising:

forming a basket with a flexible member on a bit breaker by passing the flexible member through basket apertures in a support structure of the bit breaker and extending the flexible member from the basket apertures through a linkage axially separated from the support structure;

placing the drill bit in the basket formed by the flexible member such that the flexible member is wrapped around the drill bit;

rotating one of the drill bit or the support structure to tighten the flexible member about the drill bit; and continuing to rotate one of the drill bit or the support structure to make or break a drill bit connection.

13. The method of claim 12, further comprising looping the flexible member through each basket aperture multiple times.

14. The method of claim 12, further comprising passing the drill bit through a bit aperture to place the drill bit in the basket.

15. The method of claim 12, comprising the drill bit connection being with a drill string and further comprising clamping the drill string and the support structure separately to allow relative rotating between the drill string and the support structure.

16. The method of claim 12, wherein the linkage is a static ring and the flexible member is coupled to the static ring.

17. The method of claim 16, wherein coupling the flexible member to the static ring includes looping the flexible member through a channel of the static ring.

18. The method of claim 12, further comprising centralizing the drill bit in a bit aperture with a centralizing member to align a central axis of the drill bit with a central axis of the support structure.

19. The method of claim 18, wherein the centralizing member is formed on a diameter of the bit aperture and extends radially inward toward a central axis of the support structure.

20. A system for making or breaking a connection between a drill bit and a drill string, the system comprising:

a bit breaker comprising:

a support structure including a bit aperture for receiving a portion of the drill bit and a plurality of basket apertures positioned circumferentially around the bit aperture; and a basket including a flexible member that passes through the basket apertures of the support structure to form the basket, wherein the basket extends from the support structure and is configured to receive the drill bit, wherein relative rotation between the support structure and the flexible member causes the flexible member to tighten around the drill bit so that torque may be applied to the drill bit to make or break the drill bit connection;

a drill bit clamp comprising arms that engage with the support structure of the bit breaker to lock the support structure in place; and a drill string clamp comprising arms that engage with the drill string to lock the drill string in place and enable relative rotation between the bit breaker and the drill string.

* * * * *